United States Patent [19]

Rueckl

[11] 3,989,518

[45] Nov. 2, 1976

[54] PRODUCTION OF POWDER METALLURGICAL PARTS BY FORMATION OF SINTERED PREFORMS IN THERMALLY DEGRADABLE MOLDS

[75] Inventor: Roger L. Rueckl, Franklin Boro, Pa.

[73] Assignee: United States Steel Corporation, Pittsburgh, Pa.

[22] Filed: May 8, 1975

[21] Appl. No.: 575,687

[52] U.S. Cl. ..... 75/211; 75/222; 75/223; 75/224; 75/225

[51] Int. Cl.[2] ..... B22F 3/16

[58] Field of Search ..... 75/211, 222, 203, 204, 75/225, 224, 223

[56] References Cited

UNITED STATES PATENTS 2,386,544 10/1945 Crowley ..... 75/222

3,811,878 5/1974 Chao et al. ..... 75/211 X

*Primary Examiner*—Richard E. Schafer

*Attorney, Agent, or Firm*—Arthur J. Greif

[57] ABSTRACT

Metal particles are intimately mixed with at least about 1.5 wt. percent of an organic binder. The mixture is poured into a thermally degradable mold and heated to above sintering temperature to form a preform useful for hot forging. The mold provides integrity for the packed particles until the organic compounds carbonize, which in turn effect sufficient bonding until the particles actually sinter together.

8 Claims, No Drawings

PRODUCTION OF POWDER METALLURGICAL PARTS BY FORMATION OF SINTERED PREFORMS IN THERMALLY DEGRADABLE MOLDS

This invention is related to the production of powder metal preforms and is more particularly related to a process in which such preforms are made by sintering metal particles in a thermally degradable mold.

Metal particles are normally formed into a preform for forging, by processing fully annealed and ground powder in a precision mold to a shape compatable with a forging die set. In the more conventional processes, the powders are either initially compacted under high pressures and heated to elevated temperatures to form the desired metal part; or are simultaneously compacted under high pressure and elevated temperature to produce the preform, which is employed for the production of the final part. A departure from this processing route is described in U.S. Pat. No. 3,811,878, the disclosure of which is incorporated herein by reference. Summarizing the invention described therein, as-atomized (unannealed) powder is mixed with a sucrose binder, poured into a mold and then initially baked at a temperature below the sintering temperature so as to soften the sucrose and form a baked preform with sufficient strength for handling and further processing. The decided advantages of this latter procedure, are (i) the elimination of the press to form the preform and (ii) the ability to use powder at an earlier processing stage, eliminating the need for annealing and grinding. Nevertheless, the applicability of this patented "Loose Pack" process is somewhat limited since it is dependent on the use of a binder consisting essentially of sucrose, to effect desired preform integrity.

It is therefore a principle object of this invention to provide a process, analogous to the "Loose Pack" procedure, which can nevertheless utilize a significantly wider variety of organic binding agents.

The instant invention departs from the patented "Loose Pack" process in two significant ways:

1. It utilizes organic compounds, or mixtures thereof, that assume a complex polycyclic structure on being heated to elevated temperatures. The compounds employed do not have to provide a bond equal to that of sucrose. It is only necessary that, on heating, the organic decomposition products supply adequate bonding or gluing of the metal particles, until a temperature is reached at which the metal particles sinter together to form a metal preform. It is, however, required that the organic compound or compounds, so employed, exhibit a rate of decomposition on heating, i.e., the rate of outgassing, which is not so rapid as to disrupt the packed structure of the metal powders. It has been found that these two criteria are met by virtually all thermosetting resins and carbohydrates. It should be noted, however, that while the instant invention does not depend on the use of sucrose, either as a binder or as a carburizing agent; sucrose will, of course, meet the two requisites and may so be employed. Analogously, sucrose may be employed in amounts below which it will serve as an adequate binder, i.e., less than 1.5 wt. percent; in which case the requisite amount of binder will be provided by supplementing the sucrose with any of the other satisfactory binders, noted herein. Satisfactory results have been achieved (using essentially no sucrose) utilizing complex and simple sugars, methylcellulose, starches, and phenol, melamine and urea formaldehyde resins. Materials which were found to be unsatisfactory, generally because of their tendency to outgas too rapidly, include coal tar pitches, asphalts, gilsonite and thermoplastics.

2. The mold is formed from a material which is thermally degradable at temperatures below the sintering temperature of the metal particles. The mold is so constructed so as to supply sufficient integrity to the packed metal particles for the period, during heat-up, prior to which the organic binder carbonizes or otherwise decomposes to achieve the requisite gluing effect. When the organic compounds do, in fact, decompose to achieve adequate bonding of the metal powders, the support supplied by the thermally degradable mold is no longer necessary. Thus, the mold may be so constructed as to burn off or otherwise degrade at any time subsequent to the achievement of such bonding by the organic decomposition products. For example, pressed paper pulp, similar to that used in egg cartons and other packaging, was found to supply adequate support for the requisite time period. On the other hand, another material commonly used for construction of egg cartons, i.e. foamed polystyrene, was found to degrade much too rapidly to provide such support. The use of thermally degradable or consumable molds offers two further advantages. In a high volume, high speed manufacturing line, the need to fill, discharge, and recycle a large mold inventory can seriously affect production cost. The use of such consumable molds decreases costs by eliminating both the need for recycling and for maintaining a large mold inventory. Additionally, the materials employed for such consumable molds, e.g. the pressed paper noted above, are quite amenable to being formed into complex shapes; which are difficult, if not impossible, to form utilizing conventional metal or refractory molds.

While the method of this invention may be employed for a variety of metal powders, it is particularly advantageous for use with ferrous metal particles having carbon reducible oxygen contents substantially in excess of 200 ppm (i.e., as-atomized metal powders). In the carburization of such as-atomized powders, it is desirable to know the oxide content thereof; since it is first necessary that the organic binding agent reduce the oxides before it can effectively combine with the iron powder. Since the efficiency of carburization is, to a large extent, affected by the characteristics of the powders employed, the amount of binder required to achieve a desired final carbon content (generally providing an increase $> 0.04\%$) is first determined. The proper amount of binding agent (generally between 2 to 10 wt. percent) is then blended with the metal powders. The resulting mixture, preferably essentially dry ($> 0.5\%$ moisture) is poured into a thermally degradable mold and then vibrated so as to increase the packing density of the particles, preferably to a bulk density substantially in excess of "apparent density". The packed mold is then heated to a temperature above the sintering temperature of the metal particles so as to (a) set the binder, (b) burn of the consumable mold, and form a sintered preform. The temperature of the sintered preform is then raised to forging temperature. Preferably, these latter two stages are incorporated in one physical step, in which the mold is heated directly to forging temperature (preferably in excess of 1800° F) and wherein the desired sintering is achieved during the heat-up to forging temperature. In utilizing this procedure, any suitable heating method can be employed, including dielectric or microwave heating, which is not possible with conventional metal molds. Since the heated preform, on emerging from the furnace, will already be at or near forging temperature, the sensible heat therein is preferably utilized directly for forging.

I claim:

1. A method for the production of sintered powder metal preforms, which comprises, blending an essentially dry mixture of finely divided (a) metal particles and (b) organic binder particles to obtain a uniform distribution thereof, wherein a major portion of said finely divided particles are finer than minus 6 mesh, wherein said organic binder particles are from about 1.5 to 10.0 percent of the total mixture, packing a thermally degradable mold with said blended mixture, in a protective atmosphere, heating the packed mold to a temperature within the range 1200°–2400° F for a time sufficient to achieve sintering of said metal particles, thereby forming a sintered preform with sufficient green strength for further processing, said organic binder consisting essentially of compounds, which on heating to said sintering temperature, decompose (i) to a polycyclic structure with sufficient bonding strength to maintain the integrity of the packed structure until said metal particles sinter together, (ii) at a rate which is sufficiently slow to avoid disruption of the packed structure and containing less than 1.5% sucrose, said sucrose being below that which will maintain said integrity of the packed structure;

said mold, (i) being so constructed that, on heating to said sintering temperature, it will degrade only after said organic binder has decomposed to form said polycyclic structure, and (ii) being formed of a material which degrades at a temperature below said sintering temperature.

2. The method of claim 1, wherein the particles in said mold are packed to a bulk density substantially in excess of "apparent density".

3. The method of claim 2, wherein said metal particles are composed of a ferrous alloy with a carbon reducible oxygen content substantially in excess of 200 ppm, and said organic binder is present in an amount sufficient to reduce said oxygen and increase the carbon content by a value greater than 0.04 percent.

4. The method of claim 3, wherein said binder is employed in amounts in excess of 2.0 wt. percent, and is selected from the group consisting of carbohydrates and thermosetting resins.

5. The method of claim 4, wherein said binder contains essentially no sucrose.

6. The method of claim 5, wherein said mold material is pressed paper.

7. The method of claim 6, wherein said sintering is conducted at temperatures in excess of about 1800° F for a period of at least 10 minutes.

8. The method of claim 7, wherein the resultant sintered preform is removed from the furnace and, without appreciable cooling thereof, is then forged.

* * * * *

UNITED STATES PATENT OFFICE

CERTIFICATE OF CORRECTION

Patent No. 3,989,518 Dated November 2, 1976

Inventor(s) Roger L. Rueckl

It is certified that error appears in the above-identified patent and that said Letters Patent are hereby corrected as shown below:

Column 2, line 55 "(> 0.5% moisture)" should read

-- (< 0.5% moisture) --.

Column 2, line 61, "burn of" should read -- burn off --.

Signed and Sealed this

Twenty-second Day of February 1977

[SEAL]

*Attest:*

RUTH C. MASON
*Attesting Officer*

C. MARSHALL DANN
*Commissioner of Patents and Trademarks*